US005478056A

United States Patent [19]

Kalmar et al.

[11] Patent Number: 5,478,056

[45] Date of Patent: Dec. 26, 1995

[54] SUPPORT FOR FOUNDRY LADELS FOR A CONTINUOUS CASTING

[75] Inventors: Istvan Kalmar, Vienna; Werner Scheurecker; Ronald Spannlang, both Linz, all of Austria

[73] Assignee: Voest-Alpine Industrienlagenbau GmbH, Austria

[21] Appl. No.: 277,908

[22] Filed: Jul. 20, 1994

[30] Foreign Application Priority Data

Jul. 21, 1993 [AT] Austria ..... 1452/93

[51] Int. Cl.[6] ..... B22D 11/10; C21B 3/00

[52] U.S. Cl. ..... 266/247; 266/276; 164/438

[58] Field of Search ..... 266/276, 247; 164/437, 337, 438, 335

[56] References Cited

U.S. PATENT DOCUMENTS

| | | | |
|---|---|---|---|
| 4,946,142 | 8/1990 | Vatant | 266/276 |
| 4,966,349 | 10/1990 | Scheurecker et al. | 266/276 |
| 5,228,498 | 7/1993 | Harada et al. | 164/438 |

FOREIGN PATENT DOCUMENTS

| | | |
|---|---|---|
| 0206169 | 12/1986 | European Pat. Off. . |
| 2324396 | 4/1977 | France . |
| 2430786 | 1/1975 | Germany . |

*Primary Examiner*—Scott Kastler
*Attorney, Agent, or Firm*—Ostrolenk, Faber, Gerb & Soffen

[57] ABSTRACT

A support device (1) for foundry ladles (13, 14) for a continuous casting plant has a stationary fixed base and a rotary base (4) mounted rotatably with respect to the fixed base and rotatable by means of a rotary drive, on which rotary base at least one support arm system (11, 12) for receiving a foundry ladle (13, 14) is articulated by a parallelogram linkage system (15) with arms (17 to 20) pivotable about horizontal bearing axes (24, 25), with support arm system (11, 12) viewed in outline having a rigid U-shaped support part (26) surrounding a foundry ladle (13, 14) on which part (26) foundry ladle (13, 14) is supportable and can be raised and lowered by at least one pressurized cylinder (16) with respect to rotary base (4).

In order to be able to place foundry ladles (13, 14) directly on support arm system (11, 12) even when the lengthwise direction of a continuous casting bay is not aligned parallel to the lengthwise direction of the steel works bay, the two mutually parallel legs (27, 28) each provided with a receptacle (47) for foundry ladle (13, 14), of U-shaped support part (26), viewed in outline, are aligned roughly parallel to the bearing axes (25, 24) articulating arms (17 to 20) to rotary base (4), whereby one (27) of legs (27, 28) of U-shaped support part (26) is located closer to rotary base (4) and one (28) is located further from rotary base (4) by at least one foundry ladle diameter, and the mutually parallel legs (27, 28) of the U-shaped support part (26) form a free opening (31) directed in the circumferential direction of rotary base (4).

12 Claims, 2 Drawing Sheets

SUPPORT FOR FOUNDRY LADELS FOR A CONTINUOUS CASTING

BACKGROUND OF THE INVENTION

The present invention relates to a support for foundry ladles having a stationary base and a rotary base rotatably mounted thereon, with at least one support system being connected to the rotary base by a parallelogram linkage system.

BRIEF DESCRIPTION OF RELATED ART

EP-A-0 277 discloses a support for foundry ladles having a parallelogram linkage system which is composed of upper and lower arms, with the upper arms and lower arms being connected together by beams and connecting rods, respectively. The support arm system is formed by a support part, U-shaped in outline and gripping a foundry ladle, with the cross member connecting the legs of the U engaging a pressurized cylinder, with the aid of which the support arm system is raisable and lowerable. In addition, the upper arms of the parallelogram linkage system are articulated to this box girder, while the lower arms are each articulated to one of the legs.

The support device known from EP-A-0 277 846 has two support arm systems located diametrically opposite one another, which, as is conventional in such support devices, can only be rotated jointly and not independently of one another. The free ends of the legs of the U-shaped support parts form free openings directed radially outward.

In continuous casting, one of the support arm systems bears a foundry ladle with a melt, the ladle is brought into the pouring position above the continuous casting mold (or above an intermediate vessel). The other diametrically opposite support arm system is in the waiting position, ready to receive a full foundry ladle which is swung over the mold after the other ladle is empty. The legs of the other support arm system receiving the foundry ladle form a free opening in the main transport direction of the foundry ladle, so that the ladle can be placed directly on the legs by an overhead crane.

However, when a foundry ladle is transferred to the support device, problems occur if the foundry ladle's main transport direction extends not in the pouring direction, i.e. the direction in which the billet is extracted, or does not lie in the direction of the legs of the U-shaped support arm system that are parallel to one another. This is particularly the case when the lengthwise direction of the steel works bay, which is parallel to the main transport direction of the foundry ladle, does not coincide with the lengthwise direction of the continuous casting plant (i.e., the latter is parallel to the lengthwise direction of the foundry). In order to permit a foundry ladle to be set down nevertheless on the ladle turret in such a case, one remedy that has been found is to provide a turntable on which the ladle can be placed by the overhead crane. After turning the turntable through 90 degrees, the foundry ladle can be picked up by another overhead crane, with a crane suspension that is rotated through 90 degrees relative to the first overhead crane, and transferred to the support arm system of the support device.

However, this involves a considerable loss of time, since the ladle transport using an overhead crane in the bay must take place with the ladle raised, so as to pass over the systems and equipment present in the bay. It is therefore necessary to lower the ladle from a great height onto the turntable which is located as close as possible to the mill floor level for static reasons, whereupon the foundry ladle, after rotation is complete, must again be raised to a great height from the turntable to be transported to the ladle turret. Furthermore, this process is energy-intensive and also requires a stable and correspondingly expensive to construct turntable as additional equipment as well as an additional overhead crane that can receive the foundry ladle in the rotated position.

It is also known, in order to overcome these difficulties, to provide the overhead crane itself with a rotary device so that the foundry ladle hanging from the crane can be rotated directly through 90 degrees. This solution also entails a high construction expense with additional mechanically moved parts which require regular maintenance in view of the harsh casting operations in the foundry.

SUMMARY OF THE INVENTION

An object of the invention is to avoid these disadvantages and difficulties by providing a support device for foundry ladles, with a fixed base and a rotating socket mounted rotatably with respect to the fixed base, and rotatable by means of a rotary drive, to which rotating socket at least one support arm system to receive a foundry ladle is articulated by a parallelogram linkage system with arms pivotable around horizontal bearing axes. The support arm system, viewed in outline, having a rigid U-shaped support part gripping a foundry ladle, on which the foundry ladle is supportable and raisable and lowerable by means of at least one pressurized cylinder with respect to the rotary base. Accordingly in the case when the foundry ladle main transport direction is not in the casting direction, foundry ladles can easily be placed on the support device of the invention without any additional equipment with mechanically moving parts being required. The support device according to the invention is intended to be used in particular in steel mills which are redesigned in the course of reconstruction without consideration being given to the foundry ladle main transport direction or casting direction. The support device is intended to be usable for steel mills in which, for example, because of an expansion of capacity, a continuous casting plant is added but without having to take into account the lengthwise distance of the continuous casting bay. The steel works bay and the continuous casting bay in this case can also be located at right angles to one another for optimum space utilization without entailing additional cost.

These and other goals of the invention are achieved by virtue of the fact:

- that the two legs of the U-shaped support part, which are parallel to one another and each have a receptacle for the foundry ladle, viewed in outline, are directed roughly parallel to the bearing axis articulating the legs on the rotary base,
- with one of the legs of the U-shaped support part being located closer to the rotary base and one being located further from the rotary base by at least one foundry ladle diameter, and the mutually parallel legs of the U-shaped support part forming a free opening directed in the circumferential direction of the rotary base.

A support part which is especially sturdy and simple to manufacture, and is also suitable for high foundry ladle weights and permits favorable acceptance of the forces generated by the foundry ladle to be supported, is characterized by the fact that a transverse part of the U-shaped supporting part, connecting the mutually parallel legs, viewed in outline, is directed approximately at right angles to the bearing axis articulating the arms on the rotary base.

An economical and material saving design is characterized by the fact that the leg of the U-shaped support part that is located closer to the rotary base has a larger cross-sectional dimension than the leg of the U-shaped support part that is further from the rotary base.

In this connection, the support arm system is advantageously connected with the rotary base only with the leg located closer to the rotary base by the arms of the parallelogram linkage system.

A preferred embodiment in which the support part can essentially extend in a plane, is characterized by the fact that the leg connected by the arm with the rotary base is provided with brackets projecting from the leg and receiving the bearing axis, with the brackets advantageously extending approximately vertically upward and downward from the leg.

An especially sturdy design in which the lifting and lowering mechanism can be provided in a simple fashion is characterized by the fact that the parallelogram linkage system has four arms, specifically two upper arms located at substantially the same height and two lower arms located at substantially the same height, whereby two of the arms located at a height are connected into a rigid unit by a cross member, whereby the pressurized cylinder advantageously engages the cross member connecting the arms.

Advantageously, two support arm systems are directed in the same rotational direction with the free opening formed by the free ends of the mutually parallel legs.

Other features and advantages of the present invention will become apparent from the following description of the invention which refers to the accompanying drawings.

DETAILED DESCRIPTION OF PREFERRED EMBODIMENTS OF THE INVENTION

Figure 1:
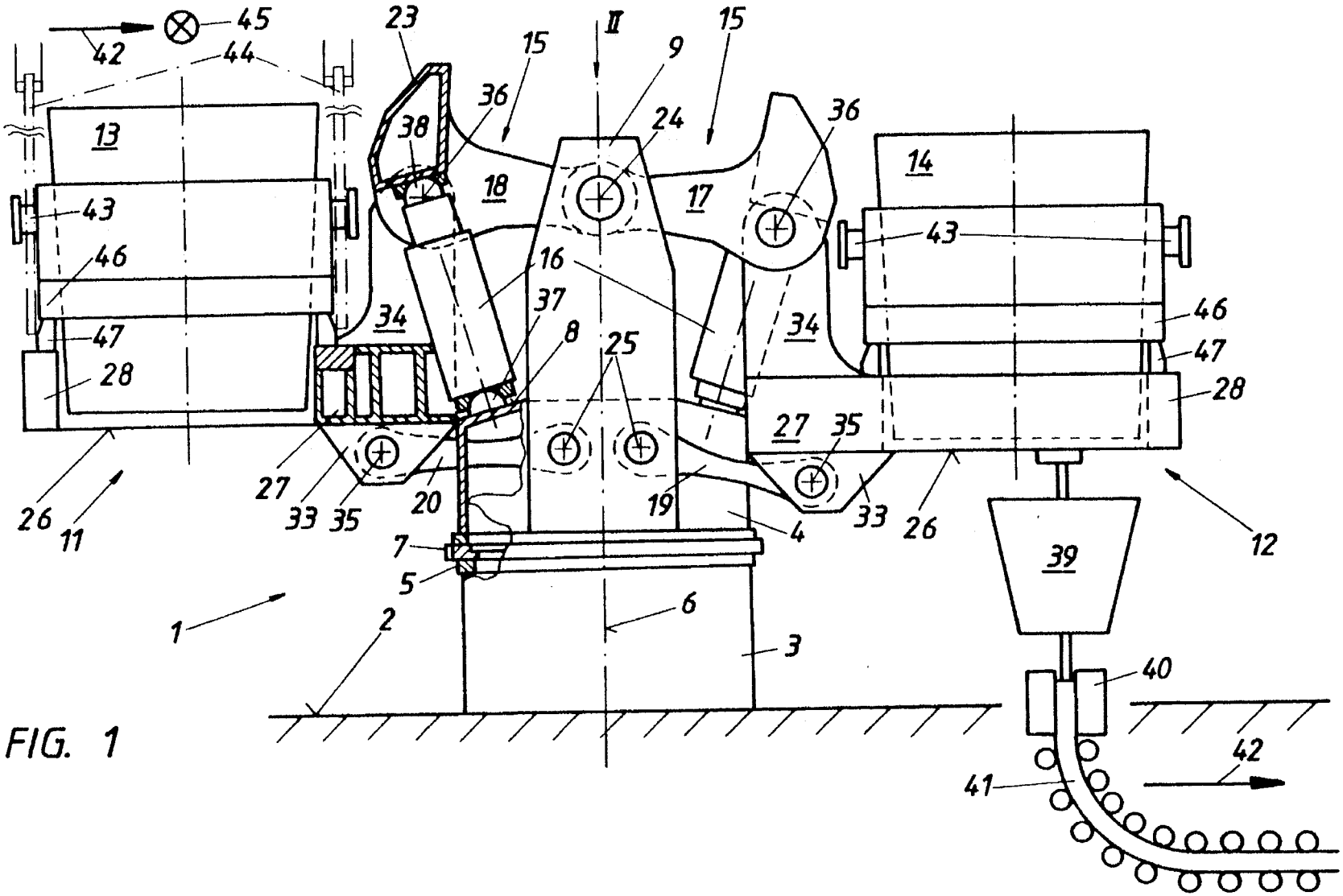
FIG. 1 shows a schematic and partially cut-away side view of a support device according to the invention including a continuous casting plant shown schematically and FIG. 2 shows a view looking in the direction of arrow II in FIG. 1.

In FIG. 1, support device 1 has an annular fixed base 3 mounted permanently on a pouring platform 2 of a continuous casting plant, with a height that is less than the diameter. On the fixed base 3, a rotary base 4 is rotatably mounted by means of a live ring bearing 5 around a vertical rotary axis 6, which is flush with the central axis of the fixed base 3, the rotary movement is effected by motors, (not shown), mounted on the fixed base 3. The motors drive pinions (not shown) engage a ring gear 7 mounted on the rotary base 4. Rotary base 4 is formed by a rotating platform 8 from which two vertical stanchions 9, 10 project (shown in FIG. 2). The stanchions 9, 10 are parallel, mounted rigidly in the vicinity of the outer circumference of rotary platform 8, and located diametrically opposite one another.

Two support arm systems 11, 12, directed in diametrically opposite directions and serving to raise and lower foundry ladles 13, 14, are mounted on the stanchions 9, 10. Each support arm system 11, 12 is vertically movable with respect to the pouring platform 2, by means of a parallelogram linkage system 15 articulated firstly at the stanchions 9, 10 and secondly on the support arm systems 11, 12 and on the rotary platform 8, with the heightwise movement being produced by a pressurized cylinder 16 such as a hydraulic cylinder.

Figure 2:
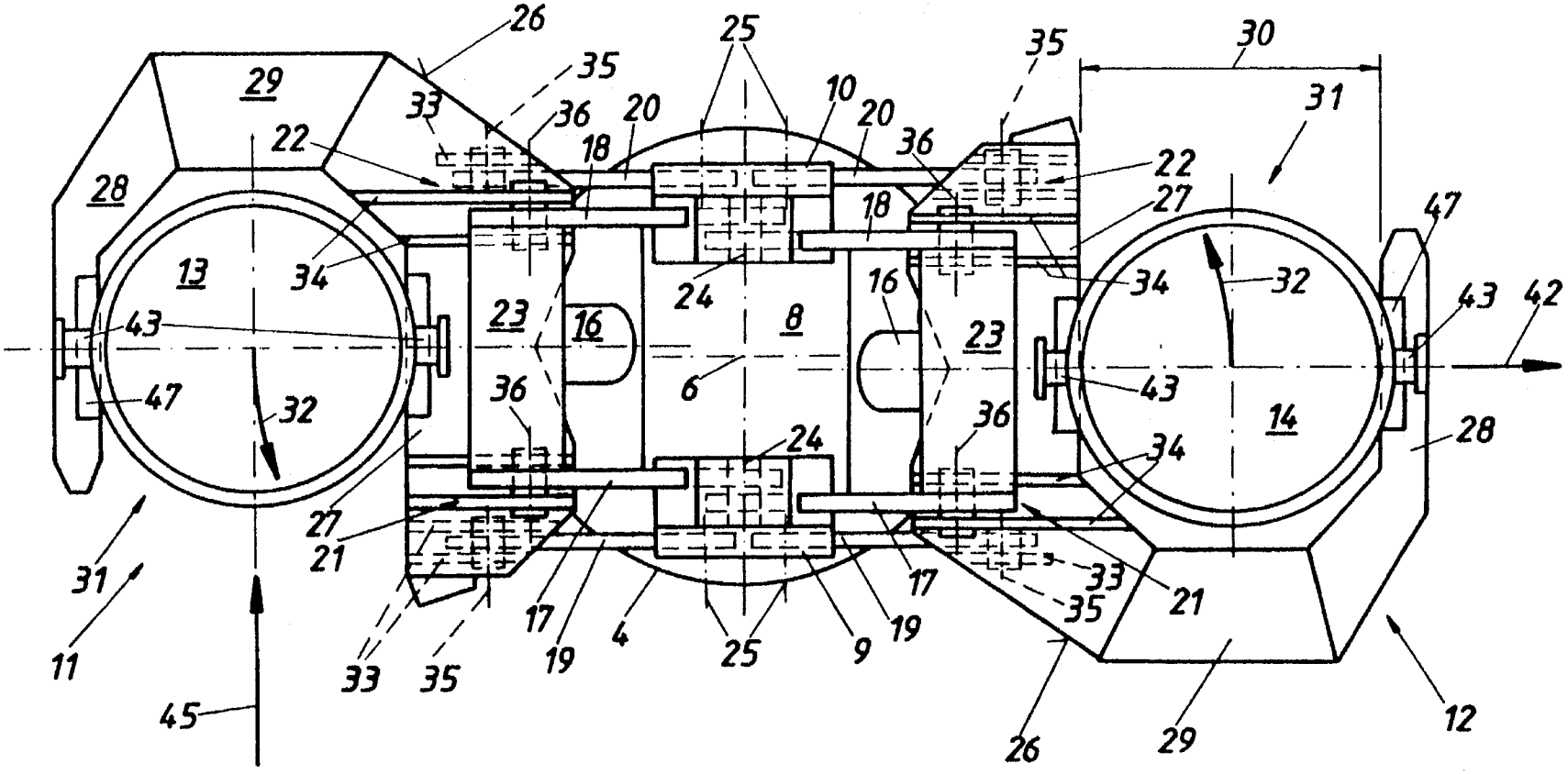

Each parallelogram linkage system 15 has two upper arms 17, 18 and two lower arms 19, 20. Each of the upper arms 17, 18 and the lower arms 19, 20, is pivotably articulated to one of stanchions 9, 10 in the vertical direction. This forms two mutually parallel parallelogram linkages 21, 22 extending in the vertical direction, whose connecting rods are each formed by one of the two support arm systems 11, 12 directed in opposite directions. The upper arms 17, 18 of these two parallelogram linkages 21, 22 (as shown in FIG. 2) are combined by a cross member 23 into a rigid unit that is U-shaped when viewed in outline, with a synchronous movement of the two parallelogram linkages 21, 22 of each of the support arm systems 11, 12 being ensured.

The upper arms 17, 18 and lower arms 19, 20 of each of the two parallelogram linkage systems 15 of the support arm systems 11, 12 are pivotably mounted on stanchions 9, 10 around bearing axes 24, 25, arranged flush and directed horizontally.

The support arm systems 11, 12 forming the connecting rods of the two parallelogram linkage systems 15 each have a support part 26, itself rigid, U-shaped when viewed in outline, and gripping a foundry ladle. The support part 26 is formed by two mutually parallel legs 27, 28 each having a receptacle for the foundry ladle, and a cross member 29 (shown in FIG. 2) connecting the two legs 27, 28. The two legs 27, 28 directed parallel to one another and cross member 29 are roughly in the same plane when viewed in a side view.

Each of the two support parts 26 is aligned relative to the rotary base 4 in such fashion that one (27) of the legs 27, the of U-shaped support part 26 is located closer to the rotary base 4 and the second leg 28 of the U-shaped support part 26 is located further from the rotary base 4 by a distance 30 that is slightly larger than the diameter of a foundry ladle 13, 14. The mutually parallel legs 27, 28 of the U-shaped support part 26 form a free opening 31 directed in the circumferential direction of the rotary base 4, i.e. the mutually parallel legs 27, 28 of the U-shaped support part 26 are aligned roughly tangentially to a the circumference of the rotary base 4 and tangentially to a rotary direction 32, with the two support arm systems 11, 12 being aligned with the free opening 31, which is formed by the free ends of the mutually parallel legs 27, 28, in one and the same rotary direction.

The leg 27 of the U-shaped support part 26 that is located closer to the rotary base 4 has a larger cross-sectional dimension than the leg 28 that is located further from the rotary base 4 and is connected with articulation by brackets 33, 34 rigidly mounted on it with the respective arms 17 to 20, whereby the brackets 33, 34, receiving bearing axes 35, 36 with their end parts, extend in a roughly vertical direction upward and downward from the respective legs 27.

Cross member 29 connecting the two legs 27, 28 of the U-shaped support part 26 in the embodiment shown is formed by a part that is aligned roughly at right angles to the lengthwise directions of the legs 27, 28. Cross member 29 can also be made in the shape of a semicircular arc. For favorable acceptance of the stresses that develop, the entire support part 26 is advantageously designed as a box.

The vertical motion of the support arm systems 11, 12 are each produced by means of the pressurized cylinder 16 which is articulated firstly by means of a bearing 37 to rotary platform 8 and secondly by means of a swivel joint 38 to cross beam 23 of the respective parallelogram linkage systems 15. The pivot joint 38, connecting pressurized cylinder 16 with cross beam 23, is arranged so that its bearing axis roughly corresponds with the bearing axis 36 of the bearing axis connecting the two upper arms 17, 18 each with a support arm system 11, 12, and the line of action of the force produced by pressurized cylinder 16 passes through the imaginary horizontal line connecting the upper arms 17, 18 with the bearing axis 36 connecting the support arm systems 11, 12. Consequently the upper arms 17, 18 are subjected primarily to tension, so that they can be designed to save weight and cost. In order to implement this simply in their design, the upper arms 17, 18 can be made essentially L-shaped when viewed from the side.

According to FIG. 1, an intermediate vessel 39 is shown below the foundry ladle 14 brought into the pouring position, the vessel 39 being brought into position above a continuous casting mold 40. From the mold 40, billet 41 is pulled out downward, bent, and conducted horizontally, with the direction of the billet guidance extending in the horizontal plane being indicated by an arrow 42, which so to speak symbolizes the casting direction. This arrow 42 is also shown in FIG. 2 and it is evident that the foundry ladle 13, 14 in support device 1 can be transported by an overhead crane (not shown) in such fashion that the ladle receptacles 43, by which the overhead crane can grasp the foundry ladles 13, 14 by means of a crane hook 44, extend in a direction that is parallel to the casting direction 42. The foundry ladle's main transport direction 45 is therefore directed at right angles to the casting direction 42, so that the foundry ladles 13, 14 can be delivered directly by the overhead crane with no problems and placed directly by means of the crane suspension 44, on the free support part 26 facing away from the continuous casting plant, with their supports 46, on receptacles 47 provided on legs 27, 28.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A support device for foundry ladles for a continuous casting plant, comprising:

a fixed base and a rotary base, the rotary base being rotatably mounted with respect to the fixed base;

means for rotating the rotary base in a rotary direction;

at least one support arm system having a support part for supporting a foundry ladle, the support part having a first and a second leg each provided with a receptacle, the receptacles of the first and second part receiving the foundry ladle to support the foundry ladle between the legs, the legs of the support part defining an opening at one end thereof;

means for raising and lowering the support part with respect to the rotary base; and a linkage system connecting the support arm system with the rotary base, the linkage system having arms pivotable about generally horizontal first bearing axes, the legs of the support part being aligned generally parallel to the first bearing axes, the first leg being located closer to the rotary base and the second leg being located further from the rotary base by at least one foundry ladle diameter, and the opening defined by the legs being directed in the rotary direction of the rotary base.

2. The support device according to claim 1 wherein the two legs of the support part are generally parallel to each other.

3. The support device according to claim 1 wherein the arms of the linkage system generally define a parallelogram.

4. The support device according to claim 1 wherein the support part is rigid and U-shaped.

5. The support device according to claim 1 wherein the support part includes a cross member for joining the legs, the cross member being directed generally at right angles to the first bearing axes.

6. The support device according to claim 1 wherein the first leg of the support part has a larger cross sectional dimension than the second leg of the support part.

7. The support device according to claim 1 wherein the support arm system is connected with the rotary base only by the first leg through corresponding arms of the linkage system.

8. The support device according to claim 7 wherein the first leg has brackets projecting therefrom, the brackets being structured and arranged for receiving respective second bearing axes.

9. The support device according to claim 8 wherein the brackets extend generally vertically upward and downward, respectively.

10. The support device according to claim 1 wherein the linkage system has four arms, a first set of two upper arms are located at substantially the same height and a second set of two lower arms are located at substantially the same height, a cross member connecting the respective upper arms of the first set to define a rigid unit.

11. The support device according to claim 10 wherein the means for raising and lowering the support part comprises a pressurized cylinder, the pressurized cylinder being arranged to engage the cross member connecting the first set of arms.

12. The support device according to claim 1 further comprising another support arm system located diametrically opposite the aforementioned support arm system, the openings defined by the respective legs of the two support arm systems being directed in the same rotary direction of the rotary base.

* * * * *

UNITED STATES PATENT AND TRADEMARK OFFICE

CERTIFICATE OF CORRECTION

PATENT NO. : 5,478,056

DATED : December 26, 1995

INVENTOR(S) : KALMAR et al.

It is certified that error appears in the above-indentified patent and that said Letters Patent is hereby corrected as shown below:

On the title page, item [54] and column 1, lines 1-2 should read as follows: --SUPPORT FOR FOUNDRY LADLES FOR A CONTINUOUS CASTING PLANT--.

Signed and Sealed this

Nineteenth Day of March, 1996

Bruce Lehman

*Attest:*

BRUCE LEHMAN

*Attesting Officer*

*Commissioner of Patents and Trademarks*